US006182317B1

(12) United States Patent
Huang

(10) Patent No.: US 6,182,317 B1
(45) Date of Patent: Feb. 6, 2001

(54) SCRAPER HAVING HAMMERING HEAD CONNECTED WITH THE BLADE

(76) Inventor: Chin-Chen Huang, No. 19-15, Alley 5, Lane Nai-tz, Sec. Shi-tuen, Taijung (TW)

( * ) Notice: Under 35 U.S.C. 154(b), the term of this patent shall be extended for 0 days.

(21) Appl. No.: 09/307,600

(22) Filed: May 10, 1999

(51) Int. Cl.[7] ..... B44C 7/00
(52) U.S. Cl. ..... 7/105; 7/165
(58) Field of Search ..... 7/105, 143, 165; 81/177.1

(56) References Cited

U.S. PATENT DOCUMENTS 3,562,826 * 2/1971 Vaughn ..... 7/105
5,063,627 * 11/1991 Marra ..... 7/105
5,546,625 * 8/1996 Mealey, Sr. ..... 7/105
5,615,445 * 4/1997 Kelsay et al. ..... 81/177.1
5,720,063 * 2/1998 Chacon ..... 7/105
5,956,799 * 9/1999 Panaccione et al. ..... 81/177.1
6,009,581 * 1/2000 Davis et al. ..... 7/105

* cited by examiner

*Primary Examiner*—David A. Scherbel
*Assistant Examiner*—Joni B. Danganan
(74) *Attorney, Agent, or Firm*—Dougherty & Troxell

(57) ABSTRACT

A scraper having a blade with a scraping end and a connecting end with two orifices, a plastic handle having two orifices corresponding to those orifices on the connecting end of the blade, a slot for mounting the connecting end of the blade, and two inserting grooves, and a hammering head with two flat pins having orifices corresponding to the orifice in the handle. The combined members are fastened by inserting two screws in the two orifices. The screw inserted into the orifice near the hammering head may be a hollow screw which can be used as a hanging hole. A screwing tip may be positioned on the hammering head.

3 Claims, 8 Drawing Sheets

SCRAPER HAVING HAMMERING HEAD CONNECTED WITH THE BLADE

TECHNICAL FIELD

The present invention relates to an improved scraper, and more particularly to a scraper having multi-functional handle.

BACKGROUND OF INVENTION

To achieve superior results when painting, sticking wallpaper or varnishing, the surface to be treated must be properly leveled by a scraper. Referring to FIGS. 1 and 2, the conventional scraper (1) comprises a scraping blade (11) and a wooden handle (2), and the connecting end (12) of the blade (11) is mounted into said handle (2). The combined scraper is then tightened by a screw 24. However, the handle for this type of scraper further needs drilling a hole for inserting said screw and producing an inserting slot for mounting said blade. Additionally, the shape and surface of the handle also needs to be finished for a better grasping. Those processes are labor- and time-consuming, and thus increase the cost. Recently, another type of scraper with a plastic handle is used instead of the above-mentioned scraper. The connecting end of the blade is attached to a molder of the handle with two pre-set orifices (21) and (22) prior to molding the handle, and a scraper is formed after molding. Finally, a screw is mounted into the orifice (21) for a further tightness. Though this type of scraper can decrease the cost, it still has drawbacks as follows:

1. The materials of the blade and handle are different, and thus the connection thereof will get loose after a period of term;
2. The plastic handle is too weak to hammer any objects stuck on the treated surface;
3. The treated surfaces usually have screws to be removed or tightened, and this type of scraper cannot satisfy this need.

SUMMARY OF INVENTION

There is thus a need to provide a scraper in addition to decrease the cost but overcome the drawbacks found in the conventional scrapers. It is an object of the invention to provide a scraper which comprises the members of a blade with a scraping end and a connecting end having two orifices; a plastic handle having two orifices corresponding to those orifices on the connecting end of the blade, a slot on one end for mounting the connecting end of the blade, and two inserting grooves on the grasp end; and a hammering head with two flat pins having orifices corresponding to the orifice on the grasp end of the handle to insert into the inserting grooves on the handle; wherein the combined members are fastened by inserting two screws on the two orifices.

It is still another object of the invention to provide a scraper, wherein the screw inserted into the orifice on the grasp end of the handle is a hollow screw used as a hanging hole.

It is a still further object of the invention to provide a scraper, wherein a screwing tip is positioned on the hammering head.

BRIEF DESCRIPTION OF DRAWINGS

For a further understanding of the nature of the present invention, reference should be made to the following detailed description in conjunction with the accompanying drawings, in which the similar elements give the same or analogous reference numbers and wherein.

DESCRIPTION OF THE PREFERRED EMBODIMENTS

Figure 1:
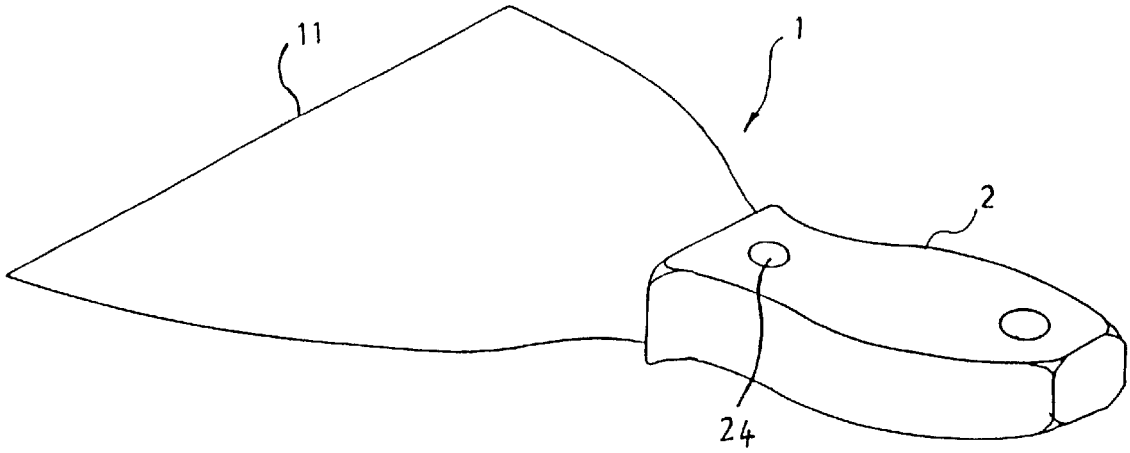
Fig 1 (PRIOR ART)
FIG. 1 is a perspective view of a conventional scraper.
Figure 2:
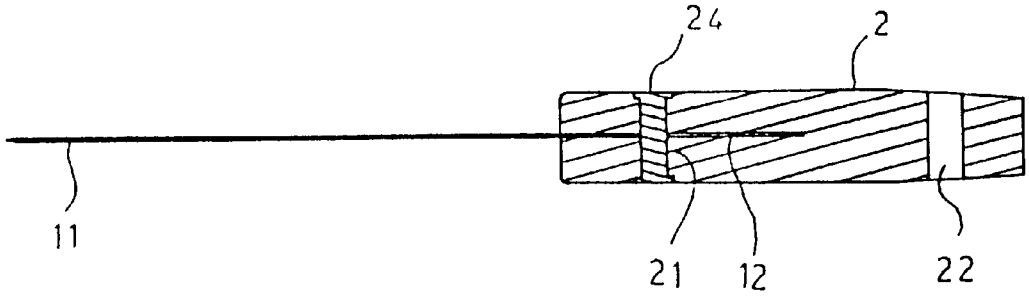
Fig 2 (PRIOR ART)
FIG. 2 is a side cross-sectional view of a conventional scraper of FIG. 1.
Figure 3A:
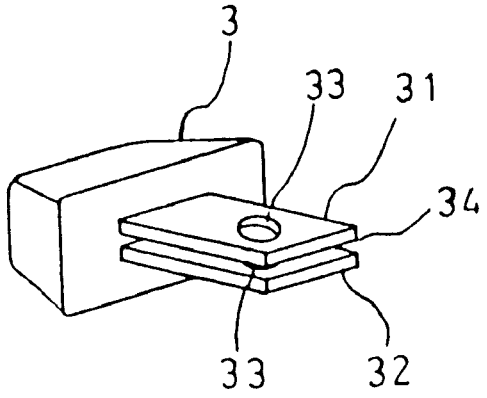
FIGS. 3A and 3B are a perspective view and a cross-sectional view of the hammering head of the present scraper.
Figure 3B:
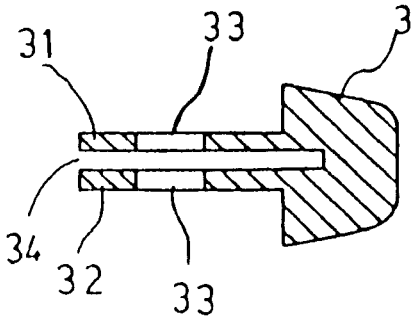
Figure 4:
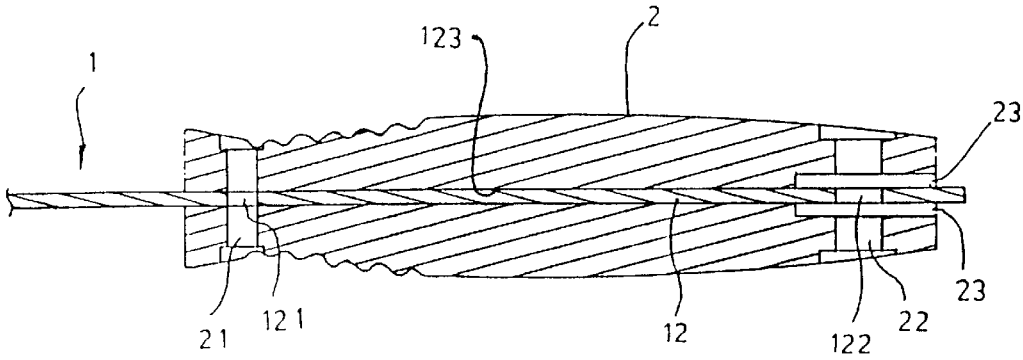
FIG. 4 is a side cross-sectional view of an embodiment of the present scraper without the hammering head.
Figure 5:
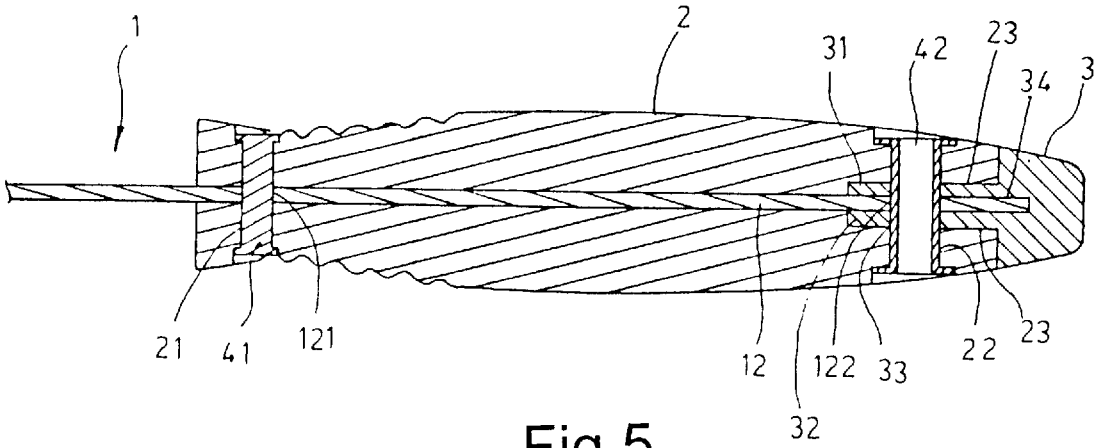
FIG. 5 is a side cross-sectional view of an embodiment of the present scraper in which the hammering head, one screw, and one hollow screw are combined together.

With reference now to FIG. 3, FIG. 4 and FIG. 5, the scraper comprises a blade (1), a plastic handle (2) and a hammering head (3). The blade (1) has a scraping end for scraping the treated surface and a connecting end (12) having two orifices (121) and (122) for mounting into the handle. The plastic handle (2) comprises two orifices (21) and (22) corresponding to those orifices on the connecting end of the blade (121) and (122), a slot (123) for mounting the connecting end (12) of the blade (1), and two inserting grooves (23) on the grasp end for inserting the hammering head (3). The hammering head (3) comprises two flat pins (31) and (32) to create a gap (34). The pins (31) and (32) have an individual orifice corresponding to the orifice on the grasp end of the handle, and they are inserted into the inserting grooves (23) to provide a hammering function for any objects on the treated surface.

When producing the scraper, the connecting end (12) of the blade (1) is mounted into the handle molder before the handle, and then the hammering head (3) is inserted into the resulting scraper at the end having the inserting grooves (23). Finally, each member of the scraper is firmly tightened by inserting two screws into the orifices. Alternatively, the screw inserted into the orifice on the grasp end of the handle may be a hollow screw used as a hanging hole.

Figure 6:
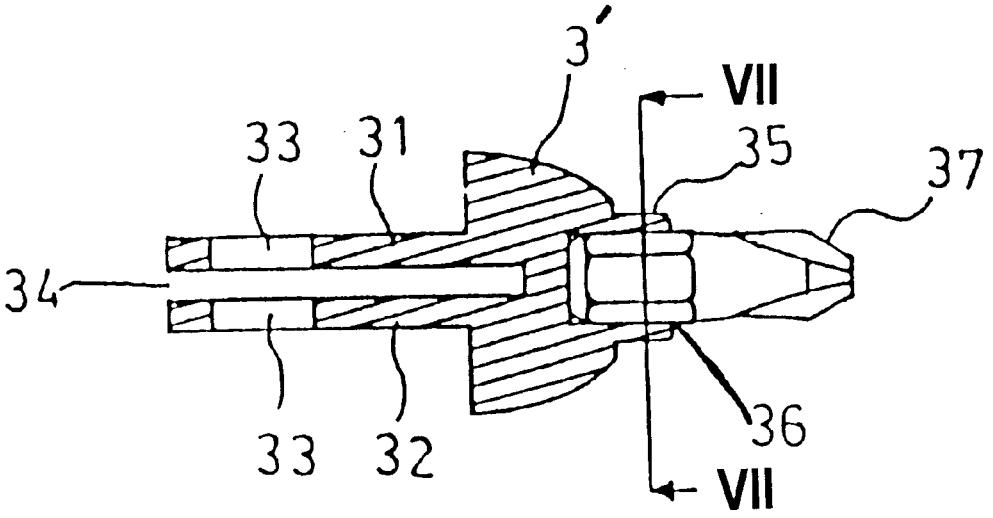
FIG. 6 is a side cross-sectional view of the hammering head on an embodiment of the present scraper, in which a screwing tip is mounted.
Figure 7:
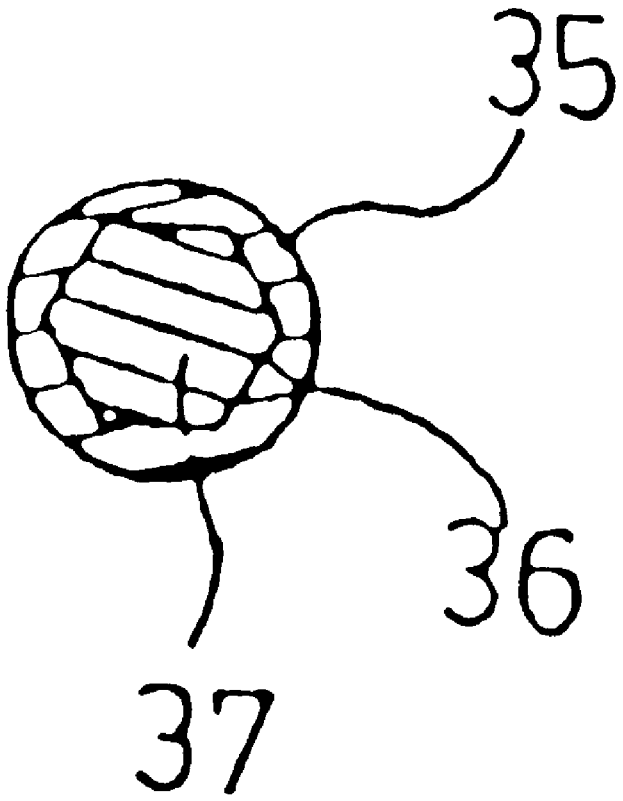
FIG. 7 is a cross-sectional view of the smashing head on an embodiment of the present scraper, taken along line VII—VII in FIG. 6.
Figure 8:
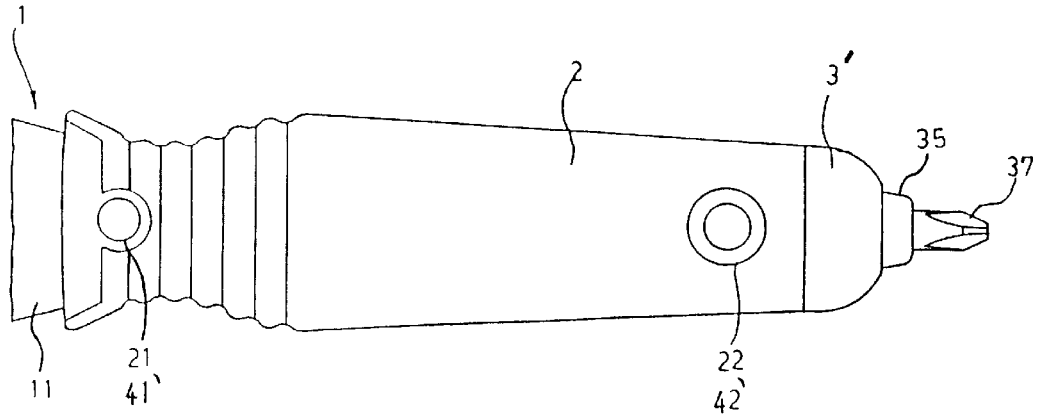
FIG. 8 is a top view of an embodiment of the present scraper.

The FIG. 6, FIG. 7 and FIG. 8 illustrate another embodiment of the invention, wherein the hammering head (3') has a fitting socket (35) with a hexagon hole (36) and a screwing tip is positioned therein.

It is noted that the embodiment of the improved scraper described herein in detail for exemplary purposes is of course subject to many different variations in structure, design, application and methodology. Being many varying and different embodiments may be made within the scope of the inventive concept(s) here taught, and many modifications may be made in the embodiment herein described in accordance with the descriptive requirements of the law. It is to be understood that the details herein are to be interpreted as illustrative and not in a limiting sense. and not in a limiting sense.

What is claimed is:

1. A scraper comprising:

a) a handle having first and second opposite ends with a slot therethrough extending between the first and second ends, and first and second orifices extending transversely through the handle adjacent to the first and second ends;

b) a blade having a scraping end and a connecting end, the connecting end located in the slot in the handle and having first and second holes aligned with the first and second orifices, respectively, the scraping end extending from the first end of the handle;

c) first and second inserting grooves formed in the handle, the first and second inserting grooves extending inwardly from the second end of the handle and located on opposite sides of the connecting end of the blade;

d) a hammering head having two, spaced apart flat pins extending therefrom, each with an aperture therethrough, the hammering head located on the second end of the handle such that the flat pins each extend into one of the inserting grooves such that the connecting end of the blade extends between the spaced apart flat pins, the apertures in the pins being aligned with the second hole in the connecting portion of the blade and the second orifices in the handle;

e) a first fastener extending through the first orifice and the first hole; and, f) a second fastener extending through the second orifice in the handle, the second hole in the connecting end of the blade and the apertures in the flat pins of the hammering head.

2. The scraper of claim 1 wherein the second fastener is hollow.

3. The scraper of claim 1 wherein the hammering head further comprises a socket having a hexagonal opening to accept a screw engaging tip therein.

* * * * *